US010597809B2

(12) United States Patent
Deshpande

(10) Patent No.: US 10,597,809 B2
(45) Date of Patent: Mar. 24, 2020

(54) WASHING MACHINE APPLIANCES INCLUDING A DAMPER

(71) Applicant: Haier US Appliance Solutions, Inc., Wilmington, DE (US)

(72) Inventor: Rajendra Dattatraya Deshpande, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 225 days.

(21) Appl. No.: 15/679,207

(22) Filed: Aug. 17, 2017

(65) Prior Publication Data

US 2019/0055687 A1 Feb. 21, 2019

(51) Int. Cl.
*D06F 37/24* (2006.01)
*D06F 37/20* (2006.01)
(Continued)

(52) U.S. Cl.
CPC ..... *D06F 37/24* (2013.01); *D06F 13/00* (2013.01); *D06F 37/20* (2013.01); *D06F 37/203* (2013.01); *D06F 37/304* (2013.01); *D06F 37/40* (2013.01); *D06F 39/005* (2013.01); *D06F 39/085* (2013.01); *D06F 39/088* (2013.01); *D06F 33/02* (2013.01); *D06F 2202/065* (2013.01); *D06F 2202/12* (2013.01); *D06F 2204/065* (2013.01);
(Continued)

(58) Field of Classification Search
CPC ..... D06F 37/20; D06F 37/203; D06F 37/22; D06F 37/24; D06F 37/268; D06F 2202/00; D06F 2202/06; D06F 2202/10; D06F 2202/12; D06F 2204/00; D06F 2204/06; D06F 2204/10; D06F 2222/00; F16F 9/0209; F16F 9/0218; F16F 9/325; F16F 9/466
See application file for complete search history.

(56) References Cited

U.S. PATENT DOCUMENTS 5,564,537 A * 10/1996 Shoureshi ..... D06F 37/225 188/380

FOREIGN PATENT DOCUMENTS

CN 203049288 U 7/2013
JP H03106394 A 5/1991
(Continued)

OTHER PUBLICATIONS

Machine Translation of Ito et al., JP 07-031788, Feb. 1995. (Year: 1995).*

*Primary Examiner* — David G Cormier
(74) *Attorney, Agent, or Firm* — Dority & Manning, P.A.

(57) ABSTRACT

A washing machine is provided herein. The washing machine appliance may include a cabinet, a tub disposed within the cabinet, and a passive pneumatic damper. The passive pneumatic damper may be attached to the tub within the cabinet. The pneumatic damper may include a rod, a casing, and a piston. The rod may extend between a first end portion and a second end portion. The casing may include a body that defines a damping chamber and an axis of motion. The body may include a first end cap and an oppositely-positioned second end cap, and a sidewall that extends between the first end cap and the second end cap. The piston may be slidable along the axis of motion within the damping chamber. The body may define a passive air aperture that extends in fluid communication between the damping chamber and an ambient atmosphere.

10 Claims, 4 Drawing Sheets

(51) Int. Cl.

| | |
|---|---|
| ***D06F 37/40*** | (2006.01) |
| ***D06F 39/08*** | (2006.01) |
| ***D06F 39/00*** | (2020.01) |
| ***D06F 37/30*** | (2020.01) |
| ***D06F 13/00*** | (2006.01) |
| *D06F 33/02* | (2006.01) |

(52) U.S. Cl.
CPC ..... *D06F 2204/10* (2013.01); *D06F 2222/00* (2013.01)

(56) References Cited

FOREIGN PATENT DOCUMENTS

| | | | |
|---|---|---|---|
| JP | H0731788 | A | 2/1995 |
| KR | 1583345 | B1 | 1/2016 |

* cited by examiner

WASHING MACHINE APPLIANCES INCLUDING A DAMPER

FIELD OF THE INVENTION

The present subject matter relates generally to washing machine appliances, such as vertical axis washing machine appliances, and dampers for washing machine appliances.

BACKGROUND OF THE INVENTION

Washing machine appliances generally include a cabinet which receives a tub for containing wash and rinse water. A wash basket is rotatably mounted within the wash tub. A drive assembly is coupled to the wash tub and configured to rotate the wash basket within the wash tub in order to cleanse articles within the wash basket. Upon completion of a wash cycle, a pump assembly can be used to rinse and drain soiled water to a draining system.

Washing machine appliances include vertical axis washing machine appliances and horizontal axis washing machine appliances, where "vertical axis" and "horizontal axis" refer to the axis of rotation of the wash basket within the wash tub. Vertical axis washing machine appliances typically have the wash tub suspended in the cabinet with damping devices. Vertical axis washing machine appliances exhibit vibration harmonics and work in a wide range of rotational speeds. Vibration has been addressed through use of fixed friction damping devices, tuned to one condition that requires the greatest amount of friction.

However, fixed friction type damping devices may have a number of undesirable issues. For example, the damping forces provided by a fixed friction type damping device may be non-uniform. Specifically, the damping forces may vary with movement speed, temperature, or the age of the damping device. If friction increases temperature to certain levels, a piston within the damping device may be damaged or welded onto a wall of a surrounding casing. The close tolerances and interference fit demanded by friction type damping devices may also create difficulties during assembly. Furthermore, the materials that may suitable for such applications are substantially limited. Further still, once assembled, fixed friction type damping devices may poorly accommodate the wide range of mass, imbalance, and rotational speed seen in vertical axis washing machine appliances.

Accordingly, a need exists for a damping device with features for addressing one or more of the above-identified issues. In particular, a damping device for a washing machine appliance that includes features for restricting damping motion without relying upon damping friction would be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure, a washing machine appliance is provided. The washing machine appliance may include a cabinet, a tub disposed within the cabinet, and a passive pneumatic damper. The passive pneumatic damper may be attached to the tub within the cabinet. The pneumatic damper may include a rod, a casing, and a piston. The rod may extend between a first end portion and a second end portion. The rod may be coupled to the cabinet at the first end portion of the rod. The casing may include a body that defines a damping chamber and an axis of motion. The body may include a first end cap and an oppositely-positioned second end cap. The body may further include a sidewall positioned about the second end portion of the rod. The body may extend between the first end cap and the second end cap. The piston may be disposed within the casing. The piston may be slidable along the axis of motion within the damping chamber. The piston may be coupled to the rod at the second end portion of the rod. The body may define a passive air aperture that extends in fluid communication between the damping chamber and an ambient atmosphere. The passive air aperture may limit a damping force of the piston within the damping chamber.

In another aspect of the present disclosure, a washing machine appliance is provided. The washing machine appliance may include a cabinet, a tub disposed within the cabinet, and a passive pneumatic damper. The passive pneumatic damper may be attached to the tub within the cabinet. The pneumatic damper may include a rod, a casing, and a piston. The rod may extend between a first end portion and a second end portion. The rod may be coupled to the cabinet at the first end portion of the rod. The casing may include a body that defines a damping chamber and an axis of motion. The body may include a first end cap and an oppositely-positioned second end cap. The body may further include a sidewall positioned about the second end portion of the rod. The body may extend between the first end cap and the second end cap. The piston may be disposed within the casing and slidable along the axis of motion within the damping chamber. The piston may be coupled to the rod at the second end portion of the rod. The piston may define a first sub-chamber and a second sub-chamber. The first sub-chamber may be defined between the first end cap and the piston. The second sub-chamber may be defined between the piston and the second end cap. The body may define a passive air aperture that extends in fluid communication between the second sub-chamber and an ambient atmosphere. The passive air aperture may limit a damping force of the piston within the damping chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
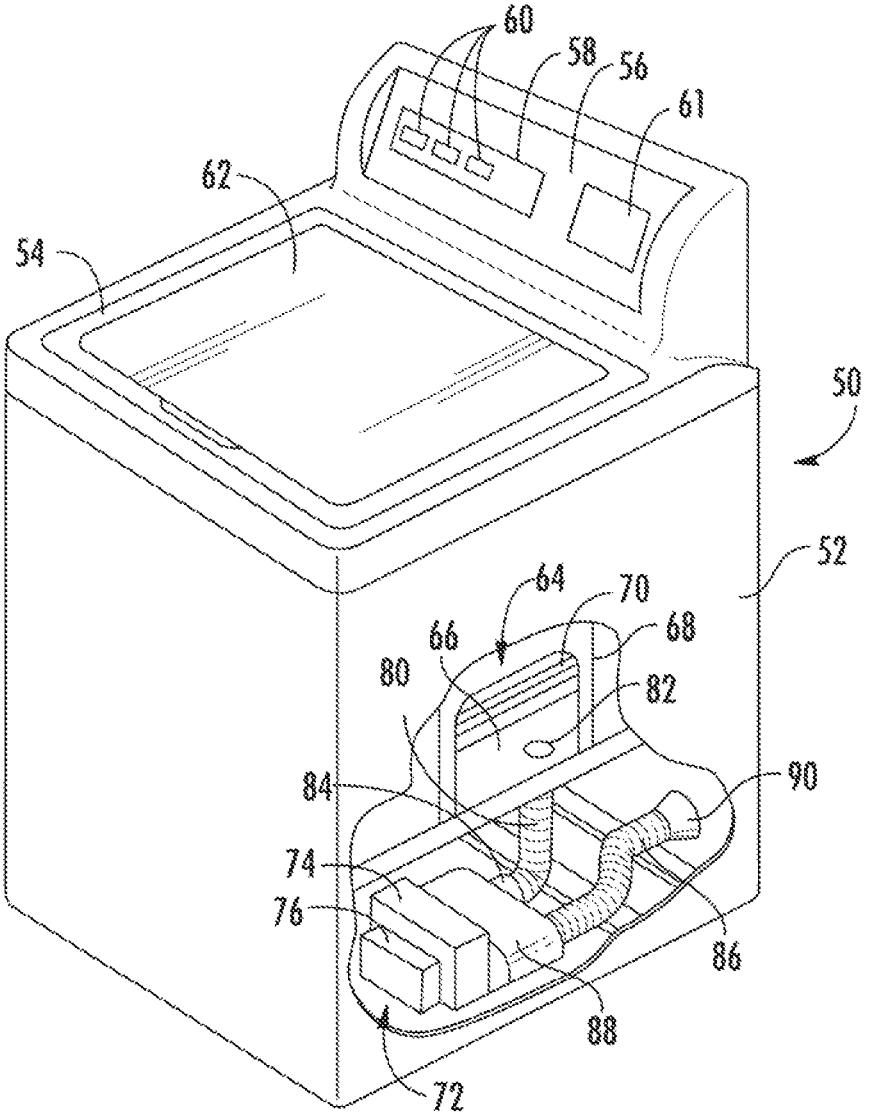
FIG. 1 provides perspective view of a washing machine appliance according to exemplary embodiments of the present disclosure with a portion of a cabinet of the exemplary washing machine appliance shown broken away in order to reveal certain interior components of the exemplary washing machine appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Turning now to the figures, FIG. 1 provides a perspective view partially broken away of a washing machine appliance 50 according to an exemplary embodiment of the present disclosure. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
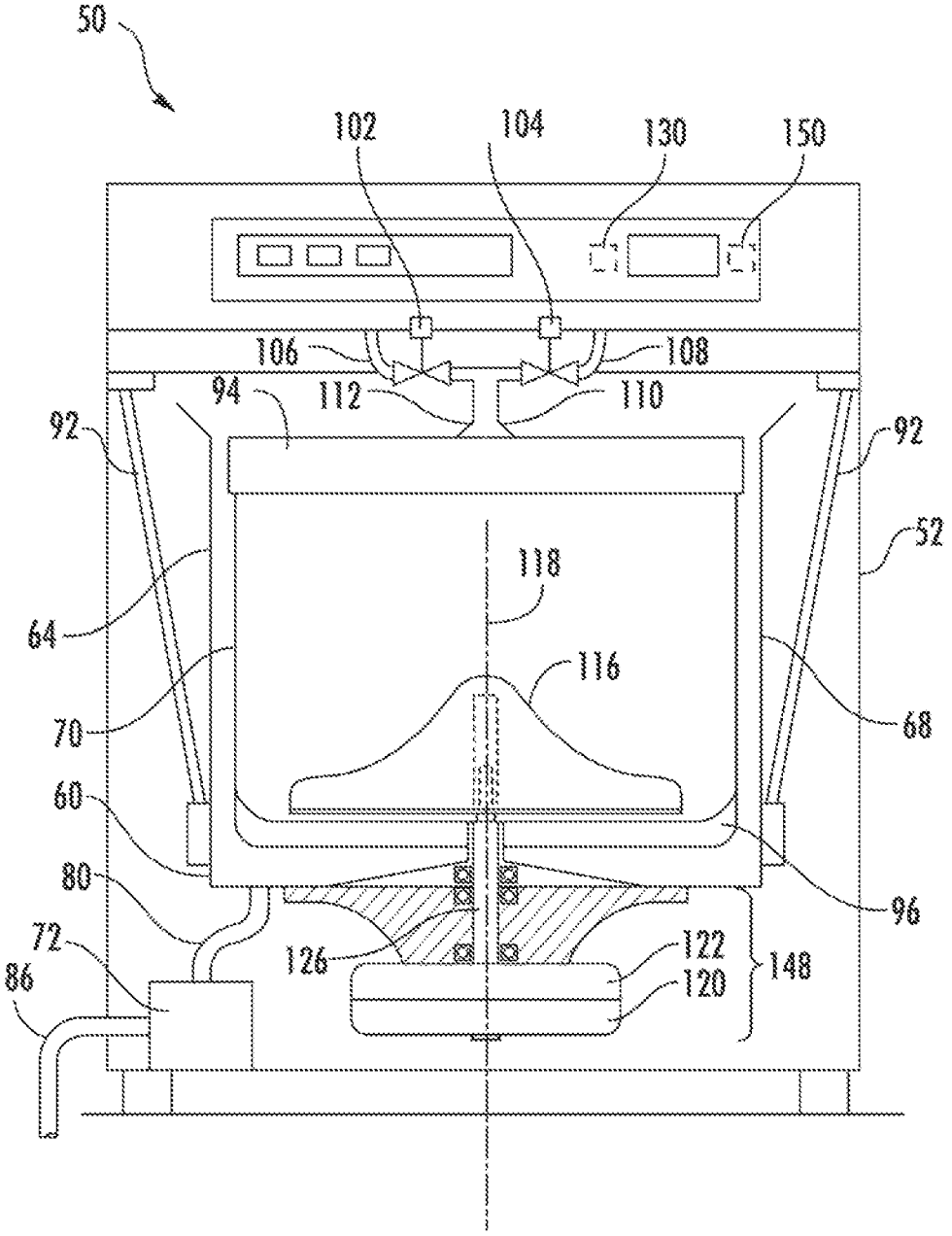
FIG. 2 provides a front elevation schematic view of certain components of the exemplary washing machine appliance of FIG. 1.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and fluid is dispersed from inlet tube 110 through a nozzle assembly 112 having a number of openings therein to direct washing liquid into basket 70 at a given trajectory and velocity. A dispenser (not shown in FIG. 2), may also be provided to produce a wash solution by mixing fresh water with a known detergent or other composition for cleansing of articles in basket 70.

An agitation element 116, such as a vane agitator, impeller, auger, or oscillatory basket mechanism, or some combination thereof is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated in FIG. 2, agitation element 116 is oriented to rotate about a vertical axis 118.

Basket 70 and agitator 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referenced herein as a motor assembly 148.

Basket 70, tub 64, and motor assembly 148 are supported by a vibration damping suspension system 92. The damping suspension system 92 can include a plurality of damping elements, such as piston-casing damping elements, coupled to the wash tub 64. The damping suspension system 92 can include other elements, such as a balance ring 94 disposed around the upper circumferential surface of the wash basket 70. The balance ring 94 can be used to counterbalance an out of balance condition for the wash machine as the basket 70 rotates within the wash tub 64. The wash basket 70 could also include a balance ring 96 located at a lower circumferential surface of the wash basket 70.

Damping suspension system 92 operates to dampen dynamic motion as the wash basket 70 rotates within the wash tub 64. The damping suspension system 92 has various natural operating frequencies of the dynamic system. These natural operating frequencies are referred to as the modes of suspension for the washing machine. For instance, the first mode of suspension for the washing machine occurs when the dynamic system including the wash basket 70, tub 64, and damping suspension system 92 are operating at the first resonant or natural frequency of the dynamic system.

Operation of washing machine appliance 50 is controlled by a controller 150 that is operatively coupled (e.g., electrically coupled or connected) to the user interface input located on washing machine backsplash 56 (FIG. 1) for user manipulation to select washing machine cycles and features. In response to user manipulation of the user interface input, controller 150 operates the various components of washing machine appliance 50 to execute selected machine cycles and features.

Controller 150 may include a memory (e.g., non-transitory storage media) and microprocessor, such as a general or special purpose microprocessor operable to execute programming instructions or micro-control code associated with a washing operation or cycle. The memory may represent random access memory such as DRAM, or read only memory such as ROM or FLASH. In one embodiment, the processor executes programming instructions stored in memory (e.g., as software). The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 (such as motor assembly 148 and measurement devices 130—discussed herein) may be in communication with controller 150 via one or more signal lines or shared communication busses to provide signals to and/or receive signals from the controller 150. Optionally, a measurement device 130 may be included with controller 150. Moreover, measurement devices 130 may include a microprocessor that performs the calculations specific to the measurement of motion with the calculation results being used by controller 150.

In specific embodiments, one or more measurement devices 130 are provided in the washing machine appliance 50 for measuring movement of the tub 64 during one or more portions of a wash cycle (e.g., an agitation phase, a rinse phase, a spin phase, etc.). Generally, movement may be measured as one or more angular speeds and/or accelerations, detected at the one or more measurement devices 130. Measurement devices 130 may measure a variety of suitable variables, which can be correlated to movement of the tub 64.

A measurement device 130 in accordance with the present disclosure may include an accelerometer which measures translational motion, such as acceleration along one or more directions. Additionally or alternatively, a measurement device 130 may include a gyroscope, which measures rotational motion, such as rotational velocity about an axis. In some embodiments, measurement device 130 is mounted to on or within backsplash 56 to sense movement of the cabinet 52 by measuring uniform periodic motion, non-uniform periodic motion, and/or excursions during appliance 50 operation. In additional or alternative embodiments, measurement device 130 is mounted to a separate portion of appliance 50. For instance, measurement device 130 may be mounted to the tub 64 (e.g., bottom wall 66 or a sidewall 68 thereof) to sense movement of the tub 64 relative to the cabinet 52 by measuring uniform periodic motion, non-uniform periodic motion, and/or excursions of the tub 64 during appliance 50 operation.

In exemplary embodiments, a measurement device 130 may include at least one gyroscope and/or at least one accelerometer. The measurement device 130, for example, may be a printed circuit board which includes the gyroscope and accelerometer thereon. The measurement device 130 may be mounted to the cabinet 52 (e.g., via a suitable mechanical fastener, adhesive, etc.) and may be oriented such that the various sub-components (e.g., the gyroscope and accelerometer) are oriented to measure movement along or about particular directions. Notably, the gyroscope and accelerometer in may be mounted at a single location (e.g., the location of the printed circuit board or other component of the measurement device 130 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted at a single location. For example, a gyroscope located at one location on cabinet 52 can measure the rotation of an accelerometer located at a different location on cabinet 52.

In an illustrative embodiment, articles (e.g., laundry items) are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of laundry items in basket 70. That is, agitation element 116 is moved back and forth in an oscillatory back and forth motion (e.g., while basket 70 remains generally stationary—i.e., not actively rotated). In the illustrated embodiment, agitation element 116 is rotated clockwise a specified amount about the vertical axis 118 of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry items are then rinsed. Moreover, basket 70 may be rotated in a spin phase and portions of the cycle may be repeated, including the agitation phase, depending on the particulars of the wash cycle selected by a user.

Figure 3:
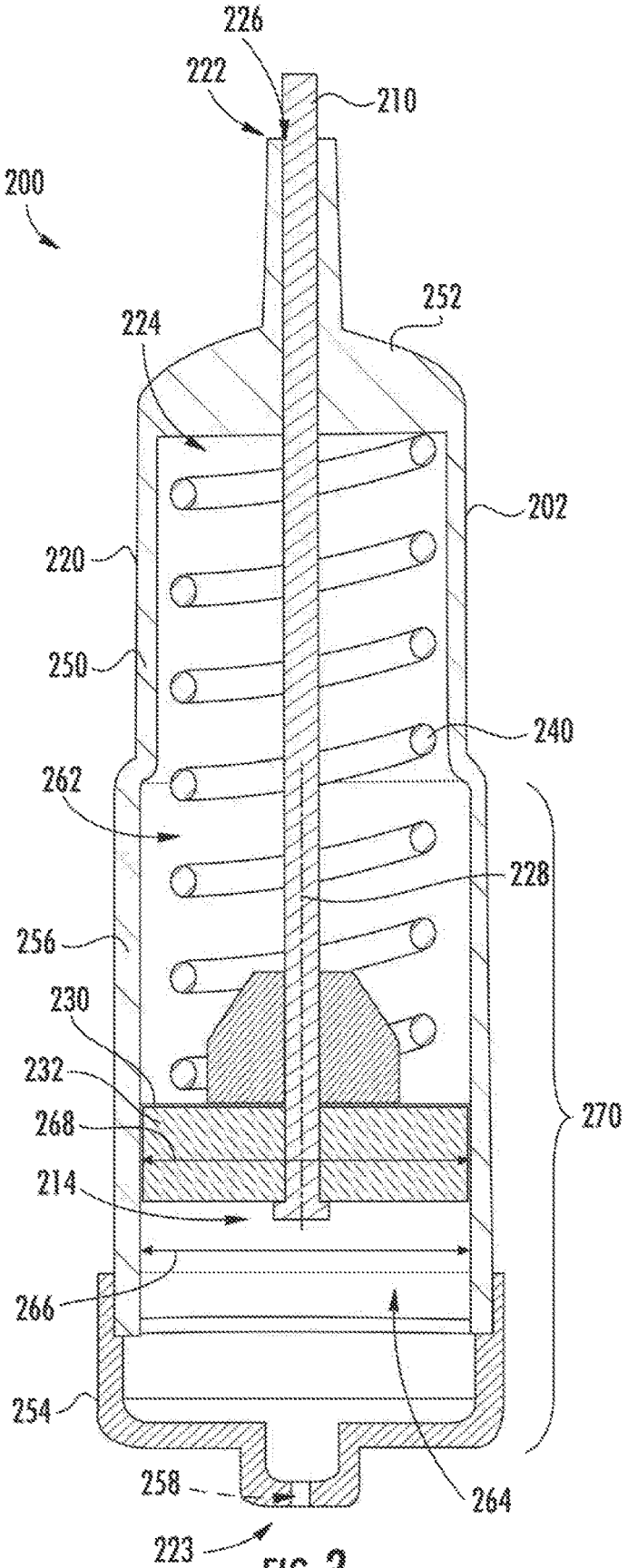
FIG. 3 provides a cross-sectional view of a damper according to exemplary embodiments of the present disclosure.

FIG. 3 provides a cross-sectional view of a damper 202 within a damper assembly 200 according to an exemplary embodiment of the present subject matter. Damper 202 may be used in any suitable washing machine appliance. For example, damper assembly 200 and/or damper 202 may be used in washing machine appliance 50 (FIG. 1) as part of damping suspension system 92 in order to couple tub 64 to cabinet 52 and dampen motion of tub 64 relative to cabinet 52 (FIG. 2).

Generally, damper assembly 200 includes a rod 210 that extends (e.g., linearly) between a first end portion (see FIG. 2) and a second end portion 214. First end portion of rod 210 may be, e.g., rotatably or pivotally, mounted or otherwise coupled to a cabinet of an associated washing machine appliance, such as cabinet 52 of washing machine appliance 50.

Damper 202 includes a cylinder or casing 220 positioned at or adjacent second end portion 214 of rod 210. Casing 220 may be mounted or fixed to tub 64 of washing machine appliance 50. Casing 220 extends between a first end portion 222 and a second end portion 223. A body 250 of casing 220 includes two end caps 252, 254 disposed on opposite ends of a sidewall 256. As shown, a first end cap 252 is positioned on the first end portion 222 of casing 220. A second end cap 254 is positioned on the second end portion 223 of casing 220. In turn, sidewall 256 extends between first end cap 252 and second end cap 254. Casing 220 also defines a damping chamber 224 within body 250. A passive air aperture 258 is defined through a portion of body 250. In some embodiments, passive air aperture 258 extends in fluid communication between damping chamber 224 and the ambient atmosphere in which casing 220 is placed (e.g., within the cabinet 52—FIG. 2). In turn, passive air aperture 258 may limit a damping force applied (e.g., at piston assembly 230).

Piston assembly 230 is disposed within damping chamber 224 of casing 220. Rod 210, which may be fixed relative to piston assembly 230, extends through casing 220 (e.g., at first end portion 222 of casing 220). For example, casing 220 may define a rod aperture 226 at first end portion 222 of casing 220 (e.g., through first end cap 252). Rod 210 may thus extend through rod aperture 226 of casing 220 into damping chamber 224 of casing 220. As shown, casing 220 also defines an axis of motion 228. When assembled, piston assembly 230 and/or rod 210 is/are movable or slidable along the axis of motion 228 within casing 220.

It is noted that although the exemplary embodiments of FIG. 3 illustrate a separate rod aperture 226 and passive air aperture 258, alternative embodiments may include a single aperture through which air may pass. As an example, rod aperture 226 may have an increased diameter relative to rod 210. As another example, an enlarged groove may be defined radially outward from the rest of rod aperture 226 and extend between damping chamber 224 and the ambient environment. The increased diameter and/or enlarged groove in such embodiments may be sufficient to permit a desired volume of air therethrough, along with rod 210. Thus, in certain embodiments, rod aperture 226 may serve as a suitable passive air aperture through body 250.

In some embodiments, a spring 240 or other biasing mechanism extends between casing 220 and piston assembly 230 within damping chamber 224 of casing 220. Spring 240 may be, for instance, a coiled compression spring. Within damping chamber 224, spring 240 biases or urges piston assembly 230 towards the second end portion 223 of casing 220. In addition, spring 240 may provide tub 64 rocking motion degrees of freedom, support tub 64 within cabinet 52, and assist with coupling casing 220 to rod 210.

Piston assembly 230 includes a piston 232 mechanically fixed or coupled to rod 210 (e.g., at the second end portion 223 thereof) and slidably disposed within damping chamber 224. When assembled, piston 232 may generally extend radially or perpendicular to the axis of motion 228 along which piston 232 slides. Moreover, piston 232 may separate damping chamber 224 into a pair of separate sub-chambers 262, 264. A first sub-chamber 262 is defined between the first end cap 252 and the piston 232 (e.g., along the axis of motion 228). A second sub-chamber 264 is defined between the second end cap 254 and the piston 232 (e.g., along the axis of motion 228). In turn, the volume of the first sub-chamber 262 will increase as the volume of the second sub-chamber 264 decreases, and vice versa.

During use, such as during motion of tub 64 relative to cabinet 52, piston 232 may compress gases (e.g., air) within damping chamber 224 of casing 220. As shown, passive air aperture 258 may be in communication with second sub-chamber 264. For instance, passive air aperture 258 may be defined through second end cap 254. In turn, air passing through or to second sub-chamber 264 may be substantially controlled or limited by passive air aperture 258. Air flow or compression directed by passive air aperture 258 thus provides damping of the motion of tub 64 relative to cabinet 52 during motion of piston assembly 230 within casing 220. Any damping forces provided by friction (e.g., between piston 232 and the inner surface 225 of sidewall 256) may be negligible. For instance, sidewall 256 may define an inner diameter 266 (e.g., radial minimum) along a length 270 of casing 220 through which piston 232 slides. Piston 232 may define an outer diameter 268 (e.g., radial maximum) that is less than the inner diameter 266 of outer diameter 268 of piston 232, such that no interference fit is formed between piston 232 and sidewall 256. Advantageously, no significant friction heat will be generated within damper 202 as piston 232 slides within damping chamber 224, regardless of the speed or force applied to piston 232. In turn, the risk of welding piston 232 to sidewall 256 is reduced or eliminated. Moreover, damping forces within damper 202 may be linearly applied or uniform across the range of motion for piston 232 within damping chamber 224.

In exemplary embodiments, such as the embodiment of FIG. 3, passive air aperture 258 is in direct fluid communication with the ambient aperture. As a result, no additional or adjustable structure that may further limit the passage of air through passive air aperture 258 is provided. The size (e.g., diameter) of passive air aperture 258 may be a fixed predetermined dimension, or set of dimensions, that is set, for example, according to testing data gathered under various conditions or load sizes of a representative appliance unit.

Figure 4:
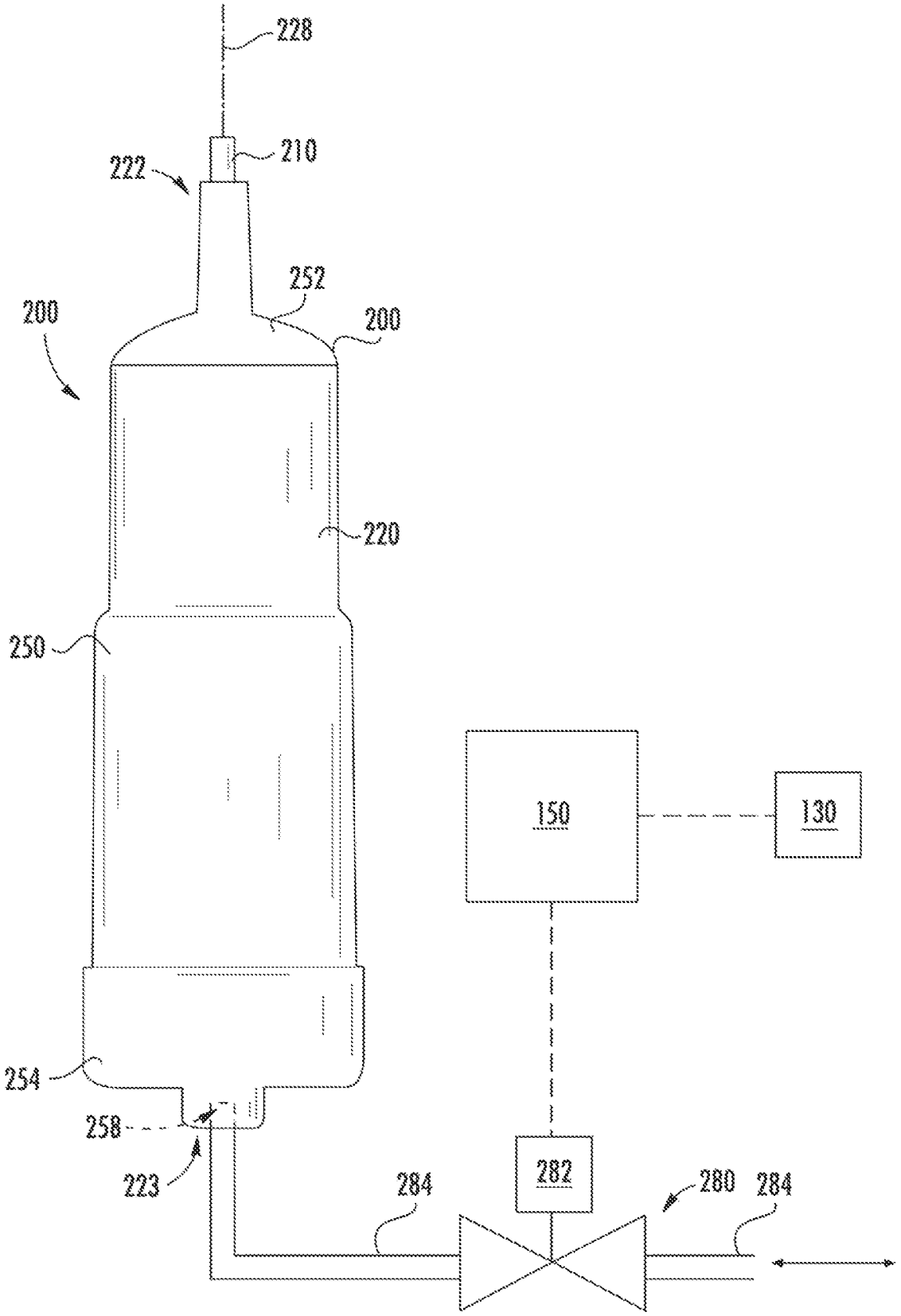
FIG. 4 provides a schematic view of a damper assembly 200 according to further exemplary embodiments of the present disclosure.

Turning now to FIG. 4, a schematic view of a damper assembly 200 that includes damper 202 is illustrated. As shown, some embodiments of damper assembly 200 include a variable orifice valve 280 that is in fluid communication with damping chamber 224. As an example, variable orifice valve 280 may be in fluid communication between the passive air aperture 258 and the ambient atmosphere. In turn, air flowing to the passive air aperture 258 may be forced to first pass through variable orifice valve 280. Similarly, air flowing from the passive air aperture 258 to the ambient atmosphere may be forced to pass from the passive air aperture 258 before flowing through variable orifice valve 280 and then to the ambient environment. In some such embodiments, one or more fluid conduits 284 defining an air passage extend between passive air aperture 258 and variable orifice valve 280 and fluidly connect damper to passive air aperture 258. Moreover, the conduits 284 and/or variable orifice valve 280 may be positioned (e.g., mounted) within the cabinet 52 (FIG. 2) and communicate with the ambient atmosphere.

During use, variable orifice valve 280 may generally serve to selectively adjust (e.g., decrease or increase) the amount of air through passive air aperture 258. In other words, the restriction of air through variable orifice valve 280 may be selectively increased and/or decreased. In certain embodiments, variable orifice valve 280 is in direct fluid communication with the ambient aperture. As a result, no additional or adjustable structure that may further limit the passage of air through variable orifice valve 280 is provided. Thus, although one or more fixed-diameter conduits (e.g., conduit 284) may be provided and the size (e.g., diameter) of variable orifice valve 280 may be selectively adjusted, no further structures between variable orifice valve 280 and ambient environment will control the volume of air permitted through variable orifice valve 280.

In some embodiments, variable orifice valve 280 includes a motor that directs or determines the air restriction (e.g., size of the variable orifice) through variable orifice valve 280. As illustrated, motor 282 may be in communication with controller 150 (e.g., electrically coupled, wirelessly coupled, etc.) through one or more signal lines or shared communication busses Controller 150 may thus direct or control the movement of motor 282 to determine the air restriction through variable orifice valve 280. For instance, controller 150 may be configured to adjust motor 282 based on one or more received movement signals. Generally, the received movement signals may correspond to movement (e.g., a magnitude of movement) detected at and received from measurement device 130. In some such embodiments, a received movement signal is compared to a predetermined threshold. The result of the comparison may subsequently lead controller 150 to increase or decrease the air restriction through variable orifice valve 280. Optionally, controller 150 can direct motor to increase air restriction through the variable orifice valve 280 (e.g., reduce the size of the variable orifice) in response to a received movement signal that exceeds the predetermined threshold. Additionally or alternatively, controller 150 may direct motor 282 to maintain the current level of air restriction in response to a received movement signal that is equal to or less than the predetermined threshold.

In further embodiments, multiple predetermined thresholds may be provided (e.g., stored within memory). For instance, a first threshold and a second threshold that is greater than the first threshold may be included in controller 150 (e.g., stored within non-transitory memory). The second threshold may indicate movement that is greater in magnitude than the first threshold. Controller 150 may thus further limit air and increase the damping forces within damper 202 when the second threshold is reached (e.g., in comparison to when the first threshold is reached and/or when neither the first nor second thresholds are reached). Controller 150 may thus direct motor 282 to a first restriction position in response to receiving the movement signal when the movement signal exceeds the first threshold. In response to receiving the movement signal when the movement signal exceeds the second predetermined threshold, controller 150 may direct motor 282 to a second restriction position that is further limiting to air through variable orifice valve 280 than the first restriction position. Advantageously, damping forces at damper 202 may be selectively adjusted without affecting or increasing the friction heat generated therein. Moreover, damping forces may be adjusted without the need or use of otherwise cumbersome equipment, such as a compressed air device.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet;

a tub disposed within the cabinet; and a passive pneumatic damper attached to the tub within the cabinet, the passive pneumatic damper comprising a rod extending between a first end portion and a second end portion, the rod coupled to the cabinet at the first end portion of the rod, a casing comprising a body defining a damping chamber and an axis of motion, the body comprising a first end cap and an oppositely-positioned second end cap, the body further comprising a sidewall positioned about the second end portion of the rod and extending between the first end cap and the second end cap, a piston disposed within the casing and slidable along the axis of motion within the damping chamber, the piston coupled to the rod at the second end portion of the rod, wherein the body defines a passive air aperture extending in fluid communication between the damping chamber and an ambient atmosphere, the passive air aperture limiting a damping force of the piston within the damping chamber, wherein the passive pneumatic damper further comprises a variable orifice valve in fluid communication with the damping chamber between the passive air aperture and the ambient atmosphere, the variable orifice valve comprising a motor directing air restriction through the variable orifice valve, wherein the washing machine appliance further comprises a controller in communication with the motor and a movement sensor mounted to the tub in communication with the controller to detect movement of the tub, the movement sensor comprising an accelerometer or gyroscope, and wherein the controller is configured to:

receive a movement signal from the movement sensor, determine the movement signal exceeds a predetermined threshold of movement magnitude, and direct the motor to increase the air restriction through the variable orifice valve in response to the movement signal exceeding the predetermined threshold.

2. The washing machine appliance of claim 1, wherein the passive air aperture is positioned within the cabinet in direct fluid communication with the ambient atmosphere.

3. The washing machine appliance of claim 1, wherein the variable orifice valve is positioned within the cabinet in direct fluid communication with the ambient atmosphere.

4. The washing machine appliance of claim 1, wherein the predetermined threshold is a first threshold, and wherein the controller is further configured to:

direct the motor to a first restriction position in response to the movement signal exceeding the first threshold, receive a second movement signal from the movement sensor, determine the second movement signal exceeds a second threshold of movement magnitude, and direct the motor to a second restriction position in response to the second movement signal exceeding the second threshold, the second restriction position being further limiting to air through the variable orifice valve than the first restriction position, and the second threshold being greater than the first threshold.

5. The washing machine appliance of claim 1, wherein the passive air aperture is defined through the second end cap.

6. A washing machine appliance, comprising:

a cabinet;

a tub disposed within the cabinet; and a passive pneumatic damper attached to the tub within the cabinet, the passive pneumatic damper comprising a rod extending between a first end portion and a second end portion, the rod coupled to the cabinet at the first end portion of the rod, a casing comprising a body defining a damping chamber and an axis of motion, the body comprising a first end cap and an oppositely-positioned second end cap, the body further comprising a sidewall positioned about the second end portion of the rod and extending between the first end cap and the second end cap, and a piston disposed within the casing and slidable along the axis of motion within the damping chamber, the piston being coupled to the rod at the second end portion of the rod, the piston defining a first sub-chamber and a second sub-chamber, the first sub-chamber being defined between the first end cap and the piston, the second sub-chamber being defined between the piston and the second end cap, wherein the body defines a passive air aperture extending in fluid communication between the second sub-chamber and an ambient atmosphere, the passive air aperture limiting a damping force of the piston within the damping chamber, wherein the passive pneumatic damper further comprises a variable orifice valve in fluid communication with the damping chamber between the passive air aperture and the ambient atmosphere, the variable orifice valve comprising a motor directing air restriction through the variable orifice valve, wherein the washing machine appliance further comprises a controller in communication with the motor and a movement sensor mounted to the tub in communication with the controller to detect movement of the tub the movement sensor comprising an accelerometer or gyroscope, and wherein the controller is configured to:

receive a movement signal from the movement sensor, determine the movement signal exceeds a predetermined threshold of movement magnitude, and direct the motor to increase the air restriction through the variable orifice valve in response to the movement signal exceeding the predetermined threshold.

7. The washing machine appliance of claim 6, wherein the passive air aperture is positioned within the cabinet in direct fluid communication with the ambient atmosphere.

8. The washing machine appliance of claim 6, wherein the variable orifice valve is positioned within the cabinet in direct fluid communication with the ambient atmosphere.

9. The washing machine appliance of claim 6, wherein the predetermined threshold is a first threshold, and wherein the controller is further configured to:

direct the motor to a first restriction position in response to the movement signal exceeding the first threshold, receive a second movement signal from the movement sensor, determine the second movement signal exceeds a second threshold of movement magnitude, and direct the motor to a second restriction position in response to the second movement signal exceeding the second threshold, the second restriction position being further limiting to air through the variable orifice valve than the first restriction position, and the second threshold being greater than the first threshold.

10. The washing machine appliance of claim 6, wherein the passive air aperture is defined through the second end cap.

* * * * *